US009828930B2

(12) United States Patent
Nistler et al.

(10) Patent No.: US 9,828,930 B2
(45) Date of Patent: Nov. 28, 2017

(54) METHOD AND SYSTEMS FOR DIAGNOSING AN INLET METERING VALVE

(71) Applicant: General Electric Company, Schenectady, NY (US)

(72) Inventors: Paul Gerard Nistler, Erie, PA (US); Jeffrey David Willis, Erie, PA (US)

(73) Assignee: General Electric Company, Schenectady, NY (US)

( * ) Notice: Subject to any disclaimer, the term of this patent is extended or adjusted under 35 U.S.C. 154(b) by 169 days.

(21) Appl. No.: 14/491,561

(22) Filed: Sep. 19, 2014

(65) Prior Publication Data

US 2016/0084190 A1 Mar. 24, 2016

(51) Int. Cl.

| | |
|---|---|
| ***F02D 41/38*** | (2006.01) |
| ***F02M 37/00*** | (2006.01) |
| ***F02D 41/22*** | (2006.01) |
| ***F02D 41/24*** | (2006.01) |
| ***F02M 63/02*** | (2006.01) |
| ***F02M 59/36*** | (2006.01) |
| *F02D 41/06* | (2006.01) |
| *F02D 41/20* | (2006.01) |

(52) U.S. Cl.

CPC ..... *F02D 41/3845* (2013.01); *F02D 41/221* (2013.01); *F02D 41/2438* (2013.01); *F02M 37/0047* (2013.01); *F02M 59/36* (2013.01); *F02M 63/0225* (2013.01); *F02D 41/062* (2013.01); *F02D 2041/2058* (2013.01)

(58) Field of Classification Search

CPC ..... F02D 41/38; F02D 41/3845; F02D 41/37; F02D 41/370047; F02D 63/0225; F02D 41/221; F02M 59/34; F02M 59/462

See application file for complete search history.

(56) References Cited

U.S. PATENT DOCUMENTS

| | | | | |
|---|---|---|---|---|
| 5,271,565 | A * | 12/1993 | Cerny | F02M 51/0675 239/533.11 |
| 6,539,785 | B1 * | 4/2003 | Nagaishi | F02D 41/18 73/114.32 |
| 9,057,347 | B2 * | 6/2015 | Veit | F02D 41/221 |
| 2010/0274467 | A1 | 10/2010 | Hayami | |
| 2013/0013175 | A1 | 1/2013 | Nistler et al. | |

FOREIGN PATENT DOCUMENTS

| | | | | |
|---|---|---|---|---|
| DE | 19604552 | A1 | 8/1997 | |
| DE | 102010017341 | A1 | 1/2001 | |
| DE | 102007000314 | A1 | 1/2008 | |
| DE | 102007000742 | A1 | 4/2008 | |
| DE | 102008011677 | A1 | 9/2009 | |
| EP | 2031221 | A2 | 3/2009 | |
| EP | 2146145 | A2 | 1/2010 | |
| GB | 1374446 | A * | 11/1974 | F02M 41/16 |

OTHER PUBLICATIONS

European Search Report and Opinion issued in connection with corresponding EP Application No. 15185690.3 on Feb. 11, 2016.

* cited by examiner

*Primary Examiner* — Hieu T Vo
(74) *Attorney, Agent, or Firm* — Global Patent Operation; John A. Kramer

(57) ABSTRACT

Various methods and systems are provided diagnosing a valve. In one example, a system comprises a valve configured to regulate a fuel flow, and a controller configured to determine degradation of the valve based on an initial opening characteristic of the valve.

20 Claims, 6 Drawing Sheets

METHOD AND SYSTEMS FOR DIAGNOSING AN INLET METERING VALVE

BACKGROUND

Technical Field

Embodiments of the subject matter disclosed herein relate to a fuel system for an engine.

Discussion of Art

The regulation of fuel pressure in a fuel rail may be provided by one or more inlet metering valves, which throttle the flow of fuel into the inlet of the high-pressure fuel pump upstream of the fuel rail. In this manner, fuel may be supplied to the fuel rail at a rate matched to the flow rate out of the rail due to fuel injection. Over time, the inlet metering valve may become degraded due to bearing degradation, for example, leading to a slower response to commanded valve position changes. Such valve degradation may result in fuel rail under- or over-pressure events, causing fuel injection errors and/or fuel rail or fuel injection degradation.

BRIEF DESCRIPTION

In one embodiment, a system comprises a valve configured to regulate a fuel flow, and a controller configured to determine degradation of the valve based on an initial opening characteristic of the valve.

DETAILED DESCRIPTION

The following description relates to embodiments for a system for determining degradation of a valve of a fuel system. In one example, the valve is an inlet metering valve that controls the flow rate of fuel upstream of a fuel rail configured to supply fuel at high pressure to one or more direct fuel injectors, for example. In another example, the valve is a relief valve that controls a flow of fuel out of the rail back to the fuel storage tank. Such fuel systems may supply diesel fuel to operate an engine in a mobile, stationary, or semi-mobile platform. Degradation of the valve may be assessed according to an initial opening of the valve, which may include the amount of current supplied to the valve at the point that the valve moves from a fully closed to an open position. As used herein, degradation refers to a change in operation of the valve, as compared to the operation of a fresh valve (e.g., newly installed valve), due to aging, wear, and/or damage to the valve. The degradation may include a change in functionality, loss of capacity, increase in hysteresis, increase or decrease in valve response time, loss of valve function (e.g., the valve being stuck open or closed), drift in valve position calibration, or other type of degradation.

In examples where the valve is an inlet metering valve, the degradation of the inlet metering valve may be assessed during engine start-up before fuel injection has commenced, for example. Such conditions allow the fuel rail pressure to be monitored independent of fuel flow out of the rail, thus isolating changes in rail pressure to changes in the inlet metering valve position. In examples where the valve is a relief valve, the degradation may be assessed responsive to an engine shut-down, where the fuel in the fuel rail is drained back to the fuel tank and changes in rail pressure due to the opening of the relief valve may be monitored independent of fuel flow into the rail.

The approach described herein may be employed in a variety of engine types, and a variety of engine-driven systems. Some of these systems may be stationary, while others may be on semi-mobile or mobile platforms. Semi-mobile platforms may be relocated between operational periods, such as mounted on flatbed trailers. Mobile platforms include self-propelled vehicles. Such vehicles can include on-road transportation vehicles, as well as mining equipment, marine vessels, rail vehicles, and other off-highway vehicles (OHV). For clarity of illustration, a locomotive is provided as an example of a mobile platform supporting a system incorporating an embodiment of the invention.

Figure 1:
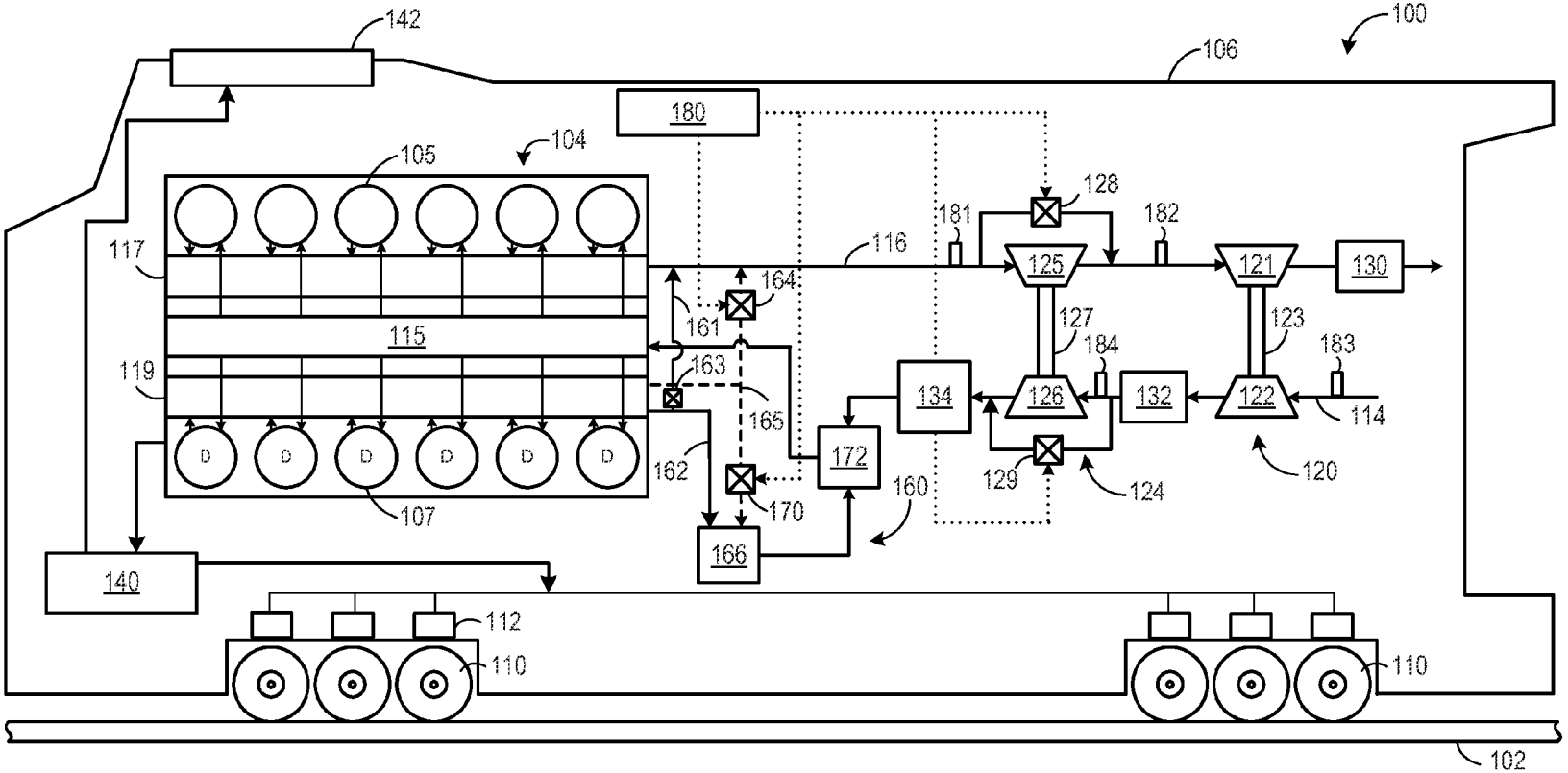
FIG. 1 shows a schematic diagram of a vehicle according to an embodiment of the invention.

Before further discussion of the approach for monitoring the health of metering fuel valve, an example of a platform is disclosed in which the engine system may be installed in a vehicle, such as a rail vehicle. For example, FIG. 1 shows a block diagram of an embodiment of a vehicle system 100 (e.g., a locomotive system), herein depicted as a rail vehicle 106, configured to run on a rail 102 via a plurality of wheels 110. As depicted, the rail vehicle includes an engine 104. In other non-limiting embodiments, the engine may be a stationary engine, such as in a power-plant application, or an engine in a marine vessel or off-highway vehicle propulsion system as noted above.

The engine receives intake air for combustion from an intake, such as an intake manifold 115. The intake may be any suitable conduit or conduits through which gases flow to enter the engine. For example, the intake may include the intake manifold, the intake passage 114, and the like. The intake passage receives ambient air from an air filter (not shown) that filters air from outside of a vehicle in which the engine may be positioned. Exhaust gas resulting from combustion in the engine is supplied to an exhaust, such as exhaust passage 116. The exhaust may be any suitable conduit through which gases flow from the engine. For example, the exhaust may include an exhaust manifold, the exhaust passage, and the like. Exhaust gas flows through the exhaust passage, and out of an exhaust stack of the rail vehicle.

In one example, the engine is a diesel engine that combusts air and diesel fuel through compression ignition. As such, the engine may include a plurality of fuel injectors to inject fuel to each cylinder of the engine. For example, each cylinder may include a direct injector that receives fuel from a high-pressure fuel rail. In other non-limiting embodiments, the engine may combust fuel including gasoline, kerosene, biodiesel, or other petroleum distillates of similar density through compression ignition (and/or spark ignition). In a still further example, the engine may combust gaseous fuel, such as natural gas. The gaseous fuel may be ignited via compression ignition of injected diesel fuel, herein referred to as multi-fuel operation, or the gaseous fuel may be ignited via spark ignition. The gaseous fuel may be supplied to the cylinders via one or more gas admission valves, for example. In further examples, the fuel may be supplied to the cylinders via port injection. The liquid fuel (e.g., diesel) may be stored in a fuel tank located on board the rail vehicle. The gaseous fuel may be stored in a storage tank located on board the rail vehicle or on board a different vehicle operably coupled to the rail vehicle.

In one embodiment, the rail vehicle is a diesel-electric vehicle (or diesel/gaseous fuel-electric hybrid). As depicted in FIG. 1, the engine is coupled to an electric power generation system, which includes an alternator/generator 140 and electric traction motors 112. For example, the engine generates a torque output that is transmitted to the alternator/generator which is mechanically coupled to the engine. The alternator/generator produces electrical power that may be stored and applied for subsequent propagation to a variety of downstream electrical components. As an example, the alternator/generator may be electrically coupled to a plurality of traction motors and the alternator/generator may provide electrical power to the plurality of traction motors. As depicted, the plurality of traction motors are each connected to one of the plurality of wheels to provide tractive power to propel the rail vehicle. One example configuration includes one traction motor per wheel. As depicted herein, six pairs of traction motors correspond to each of six pairs of wheels of the rail vehicle. In another example, alternator/generator may be coupled to one or more resistive grids 142. The resistive grids may be configured to dissipate excess engine torque via heat produced by the grids from electricity generated by alternator/generator.

In the embodiment depicted in FIG. 1, the engine is a V-12 engine having twelve cylinders. In other examples, the engine may be a V-6, V-8, V-10, V-16, I-4, I-6, I-8, opposed 4, or another engine type. As depicted, the engine includes a subset of non-donor cylinders 105, which includes six cylinders that supply exhaust gas exclusively to a non-donor cylinder exhaust manifold 117, and a subset of donor cylinders 107, which includes six cylinders that supply exhaust gas exclusively to a donor cylinder exhaust manifold 119. In other embodiments, the engine may include at least one donor cylinder and at least one non-donor cylinder. For example, the engine may have four donor cylinders and eight non-donor cylinders, or three donor cylinders and nine non-donor cylinders. It should be understood, the engine may have any desired numbers of donor cylinders and non-donor cylinders, with the number of donor cylinders typically lower than the number of non-donor cylinders. Further, in some embodiments, the engine may have no donor cylinders.

As depicted in FIG. 1, the non-donor cylinders are coupled to the exhaust passage to route exhaust gas from the engine to atmosphere. The donor cylinders, which provide engine exhaust gas recirculation (EGR), are coupled exclusively to an EGR passage 162 of an EGR system 160 which routes exhaust gas from the donor cylinders to the intake passage of the engine, and not to atmosphere. By introducing cooled exhaust gas to the engine, the amount of available oxygen for combustion is decreased, thereby reducing combustion flame temperatures and reducing the formation of nitrogen oxides (e.g., $NO_x$).

Exhaust gas flowing from the donor cylinders to the intake passage passes through a heat exchanger such as an EGR cooler 166 to reduce a temperature of (e.g., cool) the exhaust gas before the exhaust gas returns to the intake passage. The EGR cooler may be an air-to-liquid heat exchanger, for example. In such an example, one or more charge air coolers 132 and 134 disposed in the intake passage (e.g., upstream of where the recirculated exhaust gas enters) may be adjusted to further increase cooling of the charge air such that a mixture temperature of charge air and exhaust gas is maintained at a desired temperature. In other examples, the EGR system may include an EGR cooler bypass. Alternatively, the EGR system may include an EGR cooler control element. The EGR cooler control element may be actuated such that the flow of exhaust gas through the EGR cooler is reduced; however, in such a configuration, exhaust gas that does not flow through the EGR cooler is directed to the exhaust passage rather than the intake passage.

Additionally, in some embodiments, the EGR system may include an EGR bypass passage 161 that is configured to divert exhaust from the donor cylinders back to the exhaust passage. The EGR bypass passage may be controlled via a valve 163. The valve may be configured with a plurality of restriction points such that a variable amount of exhaust is routed to the exhaust, in order to provide a variable amount of EGR to the intake.

In an alternate embodiment shown in FIG. 1, the donor cylinders may be coupled to an alternate EGR passage 165 (illustrated by the dashed lines) that is configured to selectively route exhaust to the intake or to the exhaust passage. For example, when a second valve 170 is open, exhaust may be routed from the donor cylinders to the EGR cooler and/or additional elements prior to being routed to the intake passage. Further, the alternate EGR system includes a first valve 164 disposed between the exhaust passage and the alternate EGR passage.

As shown in FIG. 1, the vehicle system further includes an EGR mixer 172 which mixes the recirculated exhaust gas with charge air such that the exhaust gas may be evenly distributed within the charge air and exhaust gas mixture. In the embodiment depicted in FIG. 1, the EGR system is a high-pressure EGR system which routes exhaust gas from a location upstream of turbochargers 120 and 124 in the exhaust passage to a location downstream of the turbochargers in the intake passage. In other embodiments, the vehicle system may additionally or alternatively include a low-pressure EGR system which routes exhaust gas from downstream of the turbochargers 1 in the exhaust passage to a location upstream of the turbochargers in the intake passage.

As depicted in FIG. 1, the vehicle system further includes a two-stage turbocharger with the first turbocharger 120 and the second turbocharger 124 arranged in series, each of the turbochargers arranged between the intake passage and the exhaust passage. The two-stage turbocharger increases air charge of ambient air drawn into the intake passage in order to provide greater charge density during combustion to increase power output and/or engine-operating efficiency. The first turbocharger operates at a relatively lower pressure, and includes a first turbine 121 which drives a first compressor 122. The first turbine and the first compressor are mechanically coupled via a first shaft 123. The first turbocharger may be referred to the "low-pressure stage" of the turbocharger. The second turbocharger operates at a relatively higher pressure, and includes a second turbine 125 which drives a second compressor 126. The second turbocharger may be referred to the "high-pressure stage" of the turbocharger. The second turbine and the second compressor are mechanically coupled via a second shaft 127.

As explained above, the terms "high pressure" and "low pressure" are relative, meaning that "high" pressure is a pressure higher than a "low" pressure. Conversely, a "low" pressure is a pressure lower than a "high" pressure.

As used herein, "two-stage turbocharger" may generally refer to a multi-stage turbocharger configuration that includes two or more turbochargers. For example, a two-stage turbocharger may include a high-pressure turbocharger and a low-pressure turbocharger arranged in series, three turbocharger arranged in series, two low pressure turbochargers feeding a high pressure turbocharger, one low pressure turbocharger feeding two high pressure turbochargers, etc. In one example, three turbochargers are used in series. In another example, only two turbochargers are used in series.

In the embodiment shown in FIG. 1, the second turbocharger is provided with a turbine bypass valve 128 which allows exhaust gas to bypass the second turbocharger. The turbine bypass valve may be opened, for example, to divert the exhaust gas flow away from the second turbine. In this manner, the rotating speed of the compressor, and thus the boost provided by the turbochargers to the engine may be regulated during steady state conditions.

While a multi-stage turbine is illustrated in FIG. 1, it is to be understood that in some examples, only one turbocharger (e.g., a single stage turbocharger) may be present. In other examples, more than two turbochargers may be present, or no turbocharger may be present. Further, some examples may include a supercharger where a compressor is driven by a motor. The vehicle system 100 further includes an exhaust treatment system 130 coupled in the exhaust passage in order to reduce regulated emissions. As depicted in FIG. 1, the exhaust gas treatment system is disposed downstream of the turbine of the first (low pressure) turbocharger. In other embodiments, an exhaust gas treatment system may be additionally or alternatively disposed upstream of the first turbocharger. The exhaust gas treatment system may include one or more components. For example, the exhaust gas treatment system may include one or more of a diesel particulate filter (DPF), a diesel oxidation catalyst (DOC), a selective catalytic reduction (SCR) catalyst, a three-way catalyst, a $NO_x$ trap, and/or various other emission control devices or combinations thereof.

The vehicle system further includes the control unit 180 (also referred to as a controller), which is provided and configured to control various components related to the vehicle system. In one example, the control unit includes a computer control system. The control unit further includes non-transitory, computer readable storage media (not shown) including code for enabling on-board monitoring and control of engine operation. The control unit, while overseeing control and management of the vehicle system 100, may be configured to receive signals from a variety of engine sensors, as further elaborated herein, in order to determine operating parameters and operating conditions, and correspondingly adjust various engine actuators to control operation of the vehicle system. For example, the control unit may receive signals from various engine sensors including sensor 181 arranged in the inlet of the high-pressure turbine, sensor 182 arranged in the inlet of the low-pressure turbine, sensor 183 arranged in the inlet of the low-pressure compressor, and sensor 184 arranged in the inlet of the high-pressure compressor. The sensors arranged in the inlets of the turbochargers may detect air temperature and/or pressure. Additional sensors may include, but are not limited to, engine speed, engine load, boost pressure, ambient pressure, exhaust temperature, exhaust pressure, etc. Correspondingly, the control unit may control the vehicle system by sending commands to various components such as fraction motors, alternator, cylinder valves, throttle, heat exchangers, wastegates or other valves or flow control elements, etc.

Figure 2:
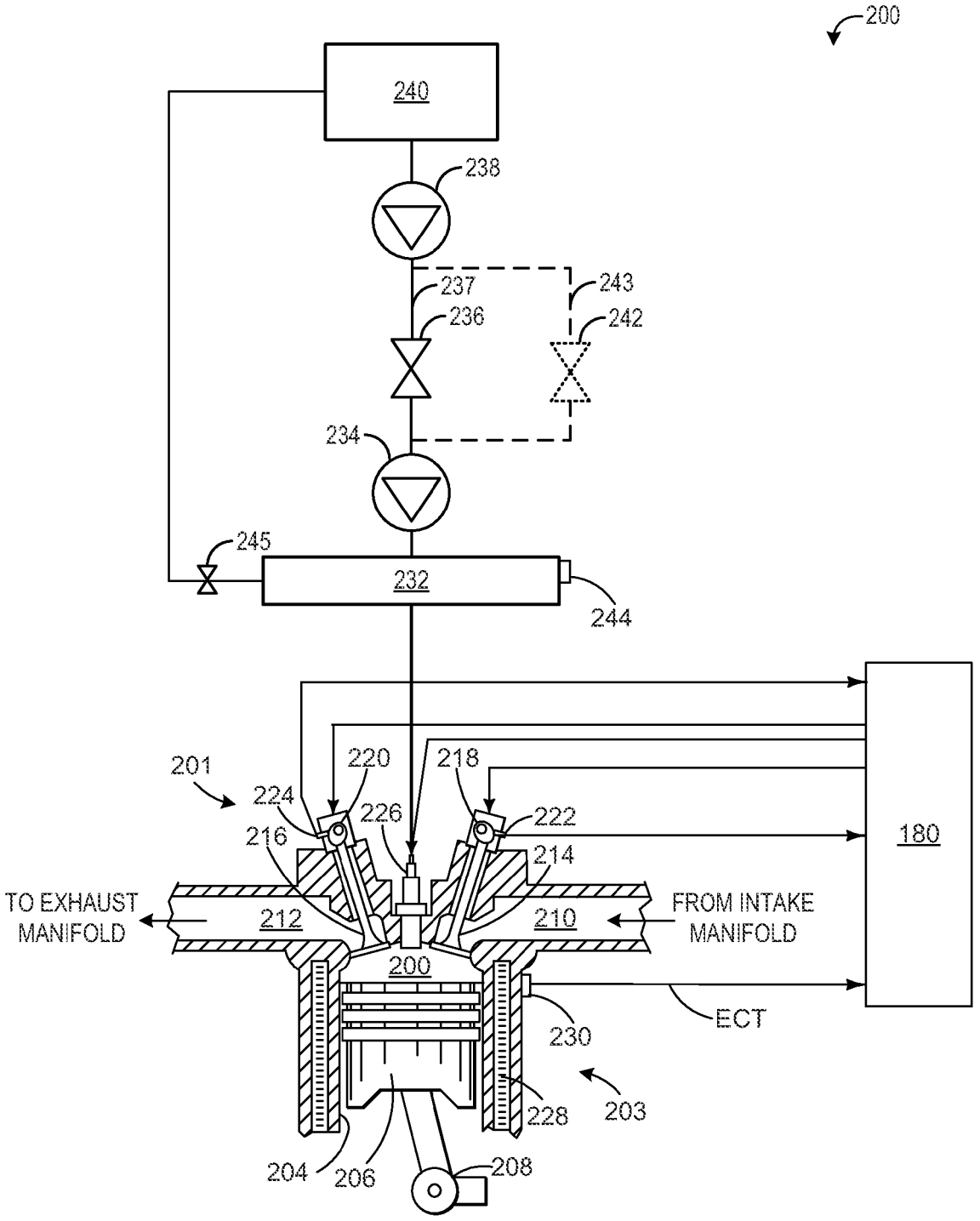
FIG. 2 shows a schematic diagram of a single cylinder of a multi-cylinder engine.

FIG. 2 depicts an embodiment of a combustion chamber, or cylinder 200, of a multi-cylinder internal combustion engine, such as the engine 104 described above with reference to FIG. 1. Cylinder 200 may be defined by a cylinder head 201, housing the intake and exhaust valves and fuel injector, described below, and a cylinder block 203. In some examples, each cylinder of the multi-cylinder engine may include a separate cylinder head coupled to a common cylinder block.

The engine may be controlled at least partially by a control system 180 including a controller which may be in further communication with a vehicle system, such as the vehicle system 100 described above with reference to FIG. 1. As described above, the controller may further receive signals from various engine sensors including, but not limited to, engine speed, engine load, boost pressure, exhaust pressure, ambient pressure, $CO_2$ levels, exhaust temperature, $NO_x$ emission, engine coolant temperature (ECT) from temperature sensor 230 coupled to cooling sleeve 228, etc. Correspondingly, the controller may control the vehicle system by sending commands to various components such as alternator, cylinder valves, throttle, fuel injectors, etc.

The cylinder (i.e., combustion chamber) may include combustion chamber walls 204 with a piston 206 positioned therein. The piston may be coupled to a crankshaft 208 so that reciprocating motion of the piston is translated into rotational motion of the crankshaft. In some embodiments, the engine may be a four-stroke engine in which each of the cylinders fires in a firing order during two revolutions of the crankshaft. In other embodiments, the engine may be a two-stroke engine in which each of the cylinders fires in a firing order during one revolution of the crankshaft.

The cylinder receives intake air for combustion from an intake including an intake runner 210. The intake runner receives intake air via an intake manifold. The intake runner may communicate with other cylinders of the engine in addition to the cylinder, for example, or the intake runner may communicate exclusively with the cylinder.

Exhaust gas resulting from combustion in the engine is supplied to an exhaust including an exhaust runner 212. Exhaust gas flows through the exhaust runner, to a turbocharger in some embodiments (not shown in FIG. 2) and to atmosphere, via an exhaust manifold. The exhaust runner may further receive exhaust gases from other cylinders of the engine in addition to the cylinder, for example.

Each cylinder of the engine may include one or more intake valves and one or more exhaust valves. For example, the cylinder is shown including at least one intake poppet valve 214 and at least one exhaust poppet valve 216 located in an upper region of the cylinder. In some embodiments, each cylinder of the engine may include at least two intake poppet valves and at least two exhaust poppet valves located at the cylinder head.

The intake valve may be controlled by the controller via an actuator 218. Similarly, the exhaust valve may be controlled by the controller via an actuator 220. During some conditions, the controller may vary the signals provided to the actuators to control the opening and closing of the respective intake and exhaust valves. The position of the intake valve and the exhaust valve may be determined by respective valve position sensors 222 and 224, respectively.

The valve actuators may be of the electric valve actuation type or cam actuation type, or a combination thereof, for example.

The intake and exhaust valve timing may be controlled concurrently or any of a possibility of variable intake cam timing, variable exhaust cam timing, dual independent variable cam timing or fixed cam timing may be used. In other embodiments, the intake and exhaust valves may be controlled by a common valve actuator or actuation system, or a variable valve timing actuator or actuation system. Further, the intake and exhaust valves may by controlled to have variable lift by the controller based on operating conditions.

In some embodiments, each cylinder of the engine may be configured with one or more fuel injectors for providing fuel thereto. As a non-limiting example, FIG. 2 shows the cylinder including a fuel injector 226. The fuel injector is shown coupled directly to the cylinder for injecting fuel directly therein. In this manner, fuel injector provides what is known as direct injection of a fuel into the combustion cylinder. The fuel may be delivered to the fuel injector from a high-pressure fuel system including a fuel tank 240, a low pressure fuel pump 238, a high pressure fuel pump 234, and a fuel rail 232. In one example, the fuel is diesel fuel that is combusted in the engine through compression ignition. In other non-limiting embodiments, the fuel may be gasoline, kerosene, biodiesel, or other petroleum distillates of similar density through compression ignition (and/or spark ignition). Further, in some examples, each cylinder of the engine may be configured to receive gaseous fuel (e.g., natural gas) alternative to or in addition to diesel fuel.

The low pressure fuel pump may pump fuel out of the fuel tank and to the high pressure fuel pump. The high pressure fuel pump may then supply fuel at high pressure to the fuel rail (hence, the fuel rail may be referred to as a high-pressure fuel rail or pressurized fuel rail), where the fuel is supplied to the cylinders via the one or more fuel injectors. To regulate the flow of fuel from the fuel tank to the fuel rail, one or more inlet metering valves may be present. As shown in FIG. 2, a first inlet metering valve (IMV) 236 is arranged in a fuel supply line 237, upstream of the fuel rail. Specifically, the first IMV is arranged upstream of the high-pressure fuel pump and downstream of the low-pressure fuel pump. The first IMV may maintain fuel flow rate into the fuel rail at a target flow rate (e.g., matched to the flow rate of fuel out of the fuel rail) and thus maintain fuel rail pressure at a target pressure. The position of the first IMV may be adjusted by the controller, based on a difference between the target rail pressure and actual rail pressure as sensed by fuel pressure sensor 244, for example.

In some embodiments, a second IMV 242 may be present in a fuel supply line 243 upstream of the fuel rail. The second IMV may be arranged in parallel with the first IMV, such that fuel flowing from the low-pressure pump is split between the two fuel supply lines, before being supplied to the high-pressure pump. In such embodiments, control of the two IMVs may be made by a single command from the controller, e.g., the two IMVs may be adjusted in tandem. However, under at least some conditions, explained in more detail below, the control of the two IMVs may be made independently, such that one IMV may be controlled a different position than the other IMV. By providing dual, parallel IMVs, a relatively large fuel flow may be controlled to a desired flow rate while still maintaining rapid valve response, by keeping the IMVs relatively small. Further, in some embodiments a relief valve 245 may be positioned in a fuel return line coupling the fuel rail to the fuel tank. The relief valve may maintain the fuel rail below a pressure threshold, by opening in response to rail pressure exceeding the pressure threshold. The relief valve may also be configured to open at engine shut-down to de-pressurize the fuel rail.

As explained above, the one or more IMVs may regulate the pressure in the fuel rail. If the one or more IMVs were to become degraded, precise fuel rail pressure regulation may be lost, leading to fuel rail pressure under or over-pressure events, causing fueling errors and in some cases fuel rail and/or fuel injector degradation. However, detection of IMV degradation during engine operation may be difficult, due to the constant flow of fuel out of the rail due to fuel injection. For example, it may be difficult to command the IMV to change position and monitor the resulting change in rail pressure, as it may cause undesired fuel rail pressure fluctuations that could cause fueling errors. Further, during transient conditions or other operating conditions where fuel injection parameters may change, it may difficult to differentiate a change in fuel rail pressure that results from a change in IMV position versus a change in fuel rail pressure that results from a change in fuel injection parameters.

According to embodiments disclosed herein, the health of an IMV may be monitored during specific operating conditions where change in fuel rail pressure is isolated to resulting from only the change in IMV position. In a first example, where a system includes a single IMV, the health of the IMV may be monitored during an engine start sequence, where fuel injection has not started but the fuel pumps are activated (e.g., during engine priming and/or cranking). During the engine start sequence, the IMV is fully closed. The IMV may be commanded closed from a default open position, or the IMV may be in a default closed position. The controller may ramp the signal provided to the IMV (e.g., the current supplied to the IMV), and monitor the change in fuel rail pressure. A change in fuel rail pressure is indicative that the IMV has opened. The current level supplied to the IMV at the time when the IMV opens may be compared to an expected current, and if the current is different than expected, it may be determined that the IMV is degraded. In a second example, where the system includes dual, parallel IMVs, the health of the IMVs may be diagnosed during idle conditions, where the fuel flow rate is relatively low and fuel injection stays relatively constant. During idle, a first IMV may be commanded closed, and the current supplied to the first IMV may be ramped down until the second IMV responds. The current supplied at the time the second IMV responds may be compared to an expected current to determine if the first IMV is degraded. The second IMV may be identified as responding based on a suitable parameter, such as output from the feedback controller regulating the position of the second IMV, the position of the second IMV (e.g., based on a position sensor or other suitable mechanism of determining the position of the second IMV), a change in fuel rail pressure, or the like. The second IMV valve may then be closed and the process repeated to diagnose the health of the second IMV valve.

If IMV degradation is detected, an operator may be notified to service and/or replace the degraded IMV. In some examples, engine operation may also be adjusted to compensate for the degraded IMV. For example, the slew rate of the IMV may be adjusted, the gains of the feedback controller for the rail pressure may be adjusted, where the feedback controller adjusts current to the IMV based on an error between desired and actual rail pressure, or other operating parameters may be adjusted. Further, in some examples where dual, parallel IMVs are present and degradation of one of the IMVs is detected, the operation of the degraded IMV may be adjusted, for example the degraded IMV may be controlled to one of a subset of restrictions (e.g., three) rather than the full plurality of restrictions at which the IMV is normally operated.

Figure 3:
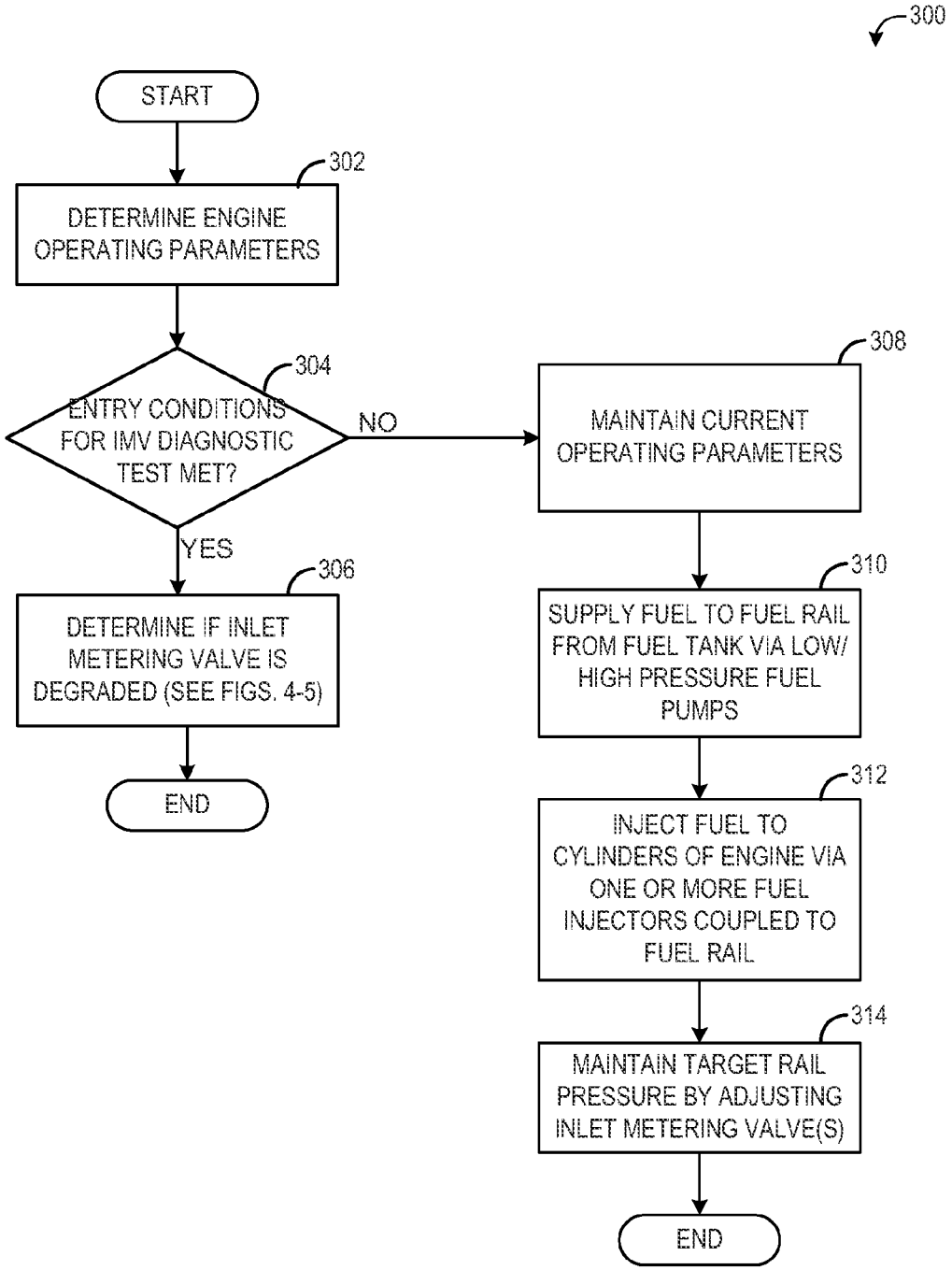
FIG. 3 is a high-level flow chart illustrating a method for diagnosing the health of one or more inlet metering valves.

Turning now to FIG. 3, a method 300 for diagnosing the health of an inlet metering valve is presented. Method 300 may be carried out by a controller according to non-transitory instructions stored on the controller, such by controller 180 of FIGS. 1-2 in order to diagnose the health of an IMV, such as first IMV 236 and/or second IMV 242 of FIG. 2. At 302, method 300 includes determining engine operating parameters. The determined engine operating parameters may include engine speed, commanded throttle position, fuel pump status, fuel injector status, fuel rail pressure, and other parameters. At 304, it is determined if entry conditions for performing an IMV diagnostic test have been met. The entry conditions may depend on whether the vehicle's fuel system includes a single IMV or dual IMVs. For a system with a single IMV, the entry conditions may include conditions where no fuel is injected and at least the low-pressure fuel pump is activated (in some examples, the entry conditions may include both the low-pressure and high-pressure fuel pumps being activated). Such conditions may occur during engine priming prior to or during an engine start sequence. During priming, the fuel pumps are activated, but fuel injection has not yet commenced, in order to pressurize the fuel rail. For systems with dual IMVs, the entry conditions may include idle operation, or other conditions where fuel flow rate is relatively low so that a single open IMV may maintain desired fuel rail pressure.

If the entry conditions have been met, method 300 proceeds to 306 to perform the IMV diagnostic test, which will be explained in more detail below with respect to FIG. 4 (for a diagnostic test on a single IMV) and FIG. 5 (for a diagnostic test on dual IMVs). If entry conditions have not been met, method 300 proceeds to 308 to maintain current operating conditions. This may include supplying fuel to the fuel rail from the fuel tank via the low-pressure and high-pressure fuel pumps, as indicated at 310, injecting fuel to cylinders of the engine via one or more fuel injectors coupled to the fuel rail, as indicated at 312, and maintaining a target fuel flow rate into the fuel rail and/or a target rail pressure by adjusting the position of one or more inlet metering valves.

Figure 4:
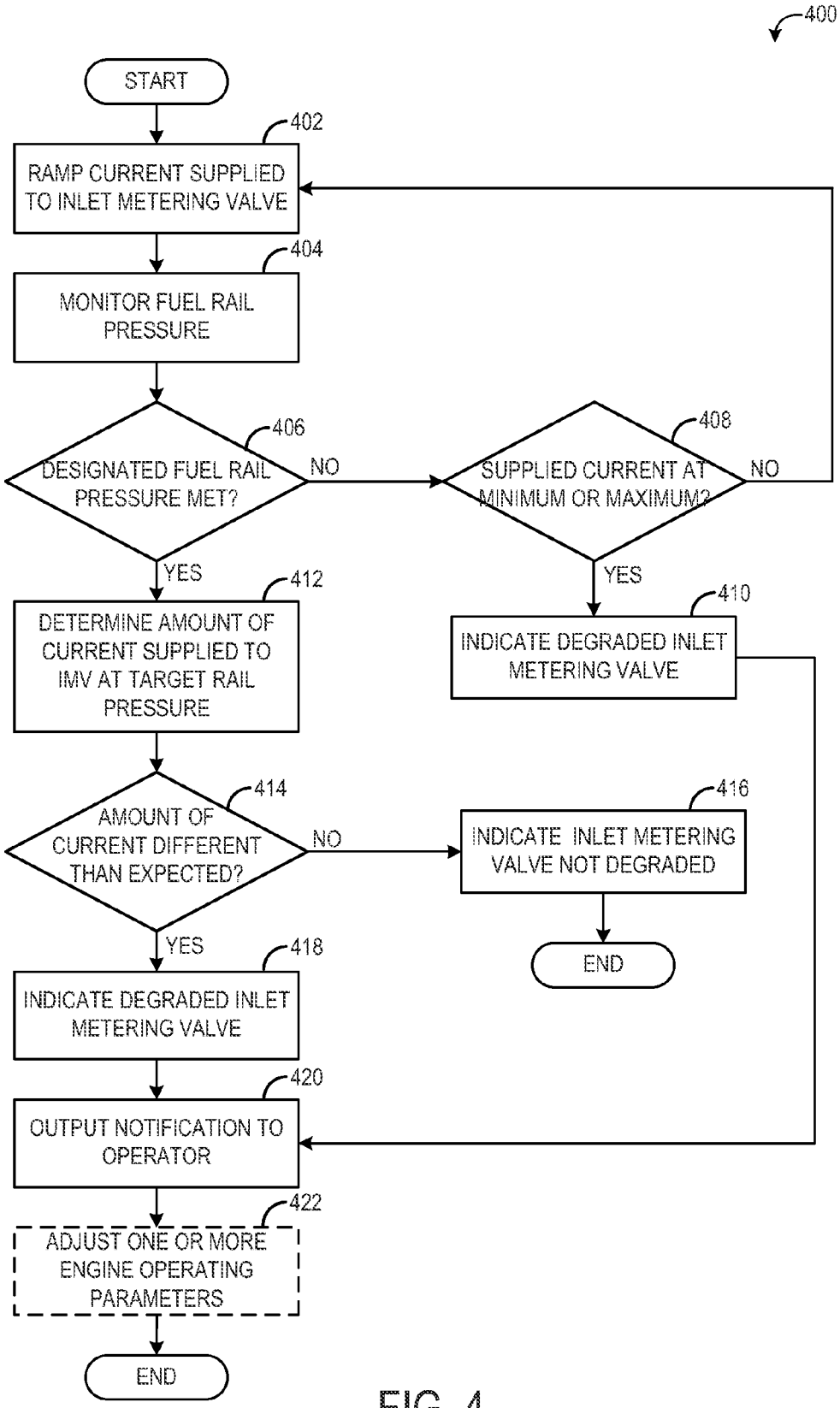
FIGS. 4-5 are flow charts illustrating diagnostic routines for determining degradation of an inlet metering valve.

FIG. 4 illustrates a method 400 for diagnosing the health of an inlet metering valve positioned upstream of a fuel rail, such as the IMV 236 of FIG. 2. Method 400 may be carried out by a controller, and may be executed as part of method 300 of FIG. 3 (for example, in response to an indication that test entry conditions have been met, e.g., an engine start/priming sequence is being initiated). At the beginning of the engine start sequence, the IMV may be in the fully closed position (e.g., the fully closed position may be the default position the IMV assumes once the engine has been shut off). Alternatively, at the start of the sequence, the IMV may be fully open, and prior to starting the diagnostic routine, the IMV may be commanded closed (e.g., a current signal may be sent to the IMV to keep it fully closed). At 402, method 400 includes ramping the current supplied to the IMV. The current may be ramped in a step-wise fashion, or it may be ramped continuously. The current may be increased or decreased, depending on the configuration of the system. In one example, where the default IMV position is closed, the current may be increased. In another example, where the default IMV position is open, the current may be decreased. The current may be increased or decreased by a suitable rate, such as a rate that allows at least one or two current levels to be supplied to the IMV prior to reaching the current level at which the IMV typically opens. At 404, method 400 includes monitoring the fuel rail pressure, via feedback from a fuel rail pressure sensor, for example.

At 406, method 400 determines if a designated fuel rail pressure is met. The designated fuel rail pressure may be a suitable pressure that indicates the IMV has opened. In one example, the designated rail pressure may be a pressure greater than barometric pressure. In another example, the designated fuel rail pressure may be a suitable pressure above a threshold rail pressure. In a further example, the designated rail pressure may be a designated rail pressure rate of change, for example, from a beginning of the test to an end of the test. In one example, the test may include determining when a minimum rail pressure is reached, to ensure that the rail is flooded, and then the rate of change of the rail pressure may be monitored starting from when the minimum pressure is detected. This is to account for the system response being strongly delayed, even if healthy, if the system is new, dry, and/or empty, to ensure that the IMV is not misdiagnosed, by checking that there is some residual pressure in the system, indicating the system is flooded.

If the designated rail pressure is not detected, method 400 proceeds to 408 to determine if the current supplied to the IMV is supplied at the minimum or maximum current allowed for the IMV (e.g., a maximum current available or a maximum current tolerated by the IMV). If no, method 400 loops back to 402 to continue to ramp up or down the current supplied to the IMV. If yes (e.g., if the current supplied to the IMV is at the minimum or maximum current yet the designated rail pressure has not been met), method 400 proceeds to 410 to indicate that the IMV is degraded, e.g., that the IMV is stuck closed. Method 400 then proceeds to 420, which will be explained in more detail below.

Returning to 406, if the designated rail pressure has been met, it is indicative that the IMV has opened, as fuel has entered the rail and increased the pressure of the rail. Method 400 proceeds to 412 to determine the amount of current supplied to the IMV at the time the target rail pressure was detected. This amount of current may be referred to as the initial opening characteristic of the IMV, and may include a single current amount value (e.g., a point at which the IMV opens, or the opening point), or may include a range of current values, for example if a rate of change of the fuel rail pressure is monitored, the range of current values supplied to the IMV during the period the rail pressure was monitored may be determined. In another example, the controller may not be able to determine the exact current that was supplied the instant the IMV opened, but may indicate a range of current values during which the IMV opened. At 414, this amount of current is compared to an expected current in order to determine if the amount of current (e.g., the initial opening characteristic) differs from the expected current by more than a threshold amount of current. The expected current may be a suitable level of current. In one example, the expected amount of current may be the amount of current typically supplied to open the IMV or may be a range of current typically supplied to the IMV to command the IMV from fully closed to partially or fully open, and the threshold amount of current may a difference from the expected amount that indicates degradation, such as a difference of 10% or greater. If the amount of current is not different than the expected current, method 400 proceeds to 416 to indicate that the inlet metering valve is not degraded, as the valve opened within a threshold range of the expected level of current. Method 400 then ends.

If the amount of current differs from the expected current by more than the threshold, for example if the amount of current differs by more than 10% from the expected current, method 400 proceeds to 418 to indicate the inlet metering valve is degraded. For example, the inlet metering valve may have a delayed response to the signal to open (e.g., the current) sent by the controller. This delayed response may result in sluggish valve control and thus undesired fuel rail pressures. In response to the indication that the IMV is degraded, a notification may be output to an operator, as indicated at 420. Further, in some examples, one or more engine operating parameters may be adjusted in response to the degradation. For example, as explained above, the degradation may cause delayed valve adjustments. Thus, if IMV degradation is detected, adjustments to the controller(s) used to regulate fuel rail pressure and/or IMV position may be made. This may include adjusting the gains, slew rate, or other adjustments.

Thus, method 400 of FIG. 4 monitors the health of a fuel inlet metering valve positioned upstream of a fuel rail by commanding the IMV closed and monitoring rail pressure as the IMV is commanded open. However, it is to be understood that a similar degradation determination could be performed on other valves, whether in the fuel system or elsewhere. For example, a fuel rail pressure relief valve could be monitored, following engine shut-down. The relief valve may be commanded closed (during conditions where it would normally be open) and the current sent to the relief valve may be ramped up or down. In one example, the default position of the relief valve may be closed, and thus the current may be ramped up to signal to open the relief valve. The fuel rail pressure may be monitored, and once the rail pressure drops by a threshold amount, it may be determined that the relief valve has opened.

Figure 5:
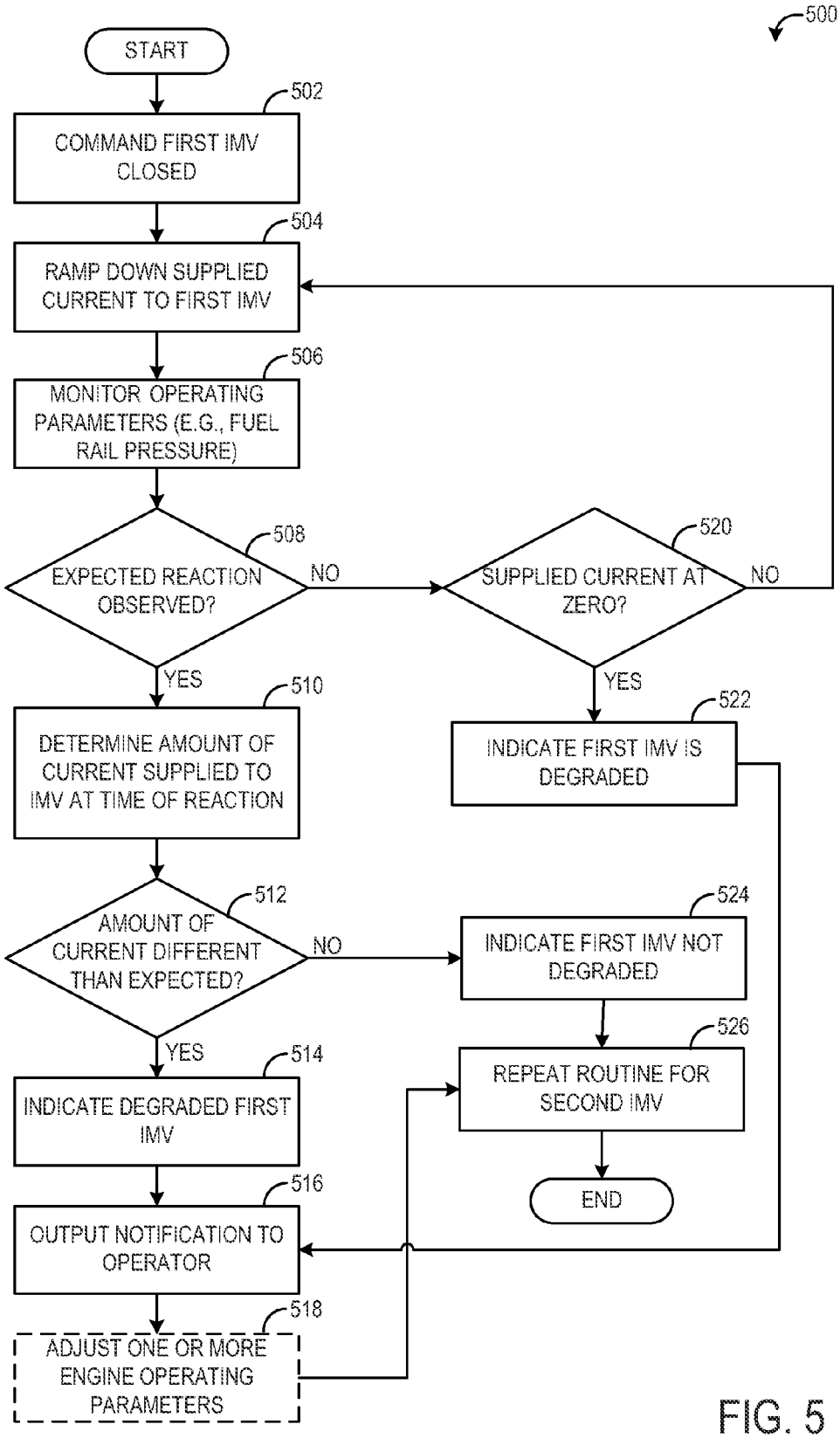

FIG. 5 illustrates a method 500 for diagnosing the health of each inlet metering valve positioned upstream of a fuel rail in a dual IMV system, such as the first IMV 236 and second IMV 242 of FIG. 2. Method 500 may be carried out by a controller, and may be executed as part of method 300 of FIG. 3 (for example, in response to an indication that test entry conditions have been met, e.g., during idle operation or other operating condition where a single IMV can handle the fuel flow). During idle operation, each IMV may be commanded to a position based on fuel rail pressure. The two IMVs may be tied to the same control signal, such that a single control signal controls both valves simultaneously. Accordingly, during idle operation before the initiation of the diagnostic routine described with respect to FIG. 5, each of the two IMVs may be in the same, at least partially open position. However, independent control of the valves is also possible, at least during some conditions.

At 502, method 500 includes commanding the first IMV to a closed position. As explained above, while the IMVs are typically controlled simultaneously from a single control signal, independent control may be used to close the first IMV while keeping the second IMV open. Once the first IMV is closed, the second IMV may move to a more open position in order to maintain the fuel rail pressure at a target (e.g., commanded) rail pressure.

At 504, the current supplied to the first IMV is ramped down, such that the first IMV slowly receives less and less current. As the current is ramped down, one or more operating parameters is monitored, including controller output, IMV position, fuel rail pressure, etc., as indicated at 506. At 508, method 500 determines if an expected reaction of the second IMV is observed, based on the monitored operating parameters. In one example, the expected reaction may include the second IMV changing position in response to the first IMV opening, in order to maintain target rail pressure. The expected reaction may be determined by monitoring the output from the controller used to control the position of the second IMV, e.g., a closed-loop feedback controller that adjusts the position of the first and second IMV based on rail pressure. In another example, the expected reaction may include an expected change in fuel rail pressure, e.g., if the IMV controller is an open-loop controller, a change in rail pressure may be observed when the first IMV reopens and the second IMV starts to change position in response to the opening of the first IMV.

As will be explained in more detail below with respect to FIG. 7, when the current to the first IMV is ramped down until the opening point is reached, the first IMV will be triggered to reopen. When the first IMV reopens, the second IMV will respond, which may be determined based on output from the feedback controller of the IMVs (e.g., the controller may command the second IMV to change position. Thus, the expected reaction resulting from ramping down of the current to the first IMV may include a command from the controller to change the position of the second IMV. However, other reactions are possible. For example, a change in fuel rail pressure may be monitored, or the current supplied to the second IMV may be monitored. When the first IMV reopens, the current to the second IMV may drop as a result of the first IMV opening, for example.

If it is determined at 508 that the expected reaction was observed, method 500 proceeds to 510 to determine the amount of current supplied to the second IMV at the time of the expected reaction. For example, the amount of current supplied to the first IMV when the fuel rail pressure begins to increase may be determined. This amount of current may be designated as the initial opening characteristic of the first IMV, where the amount of current (either a single value or point, or a range of values) supplied causes the first IMV to move from fully closed to at least partially open.

At 512, it is determined if the amount of current supplied when the first IMV reopens differs from an expected current by more than a threshold amount. The expected current may be the amount of current typically supplied to reopen to the first IMV after being commanded closed. If the amount of current is different than expected, such as if the amount of current is less than expected by at least a threshold amount (e.g., 10% of the expected amount), method 500 proceeds to 514 to indicate that the first IMV is degraded. The first IMV may be indicated as degraded due to the delay in responding to the drop in supplied current.

In response to detecting that the first IMV is degraded, a notification is output to an operator at 516. Further, in some examples, at 518, one or more engine operating parameters may be adjusted in response to the detected IMV degradation. These adjusted engine operating parameters may include adjustments to the control of the fuel rail pressure, e.g., adjusting the gains, slew rate, or other parameters of the controller used to regulate the position of the degraded IMV. In another example, the adjusted engine operating parameters may include adjusting control of the degraded IMV such that the degraded IMV is adjusted among only a subset of possible restrictions available to the degraded IMV, while maintaining control of the other, non-degraded IMV to all available restrictions. For example, the degraded IMV may be adjusted to one of only three restrictions, while the non-degraded IMV may be adjusted to more than three restrictions (e.g., the maximum number of restrictions available to the valve, which in a continuously variable adjustable valve may include a near-infinite number of restrictions). In this way, coarse fuel flow adjustments may be made by the degraded valve, where the delayed valve response may be less problematic than during fine fuel flow control. At 526, the routine is repeated for the second IMV (e.g., the second IMV is commanded closed, and then the current to the second IMV is ramped down until an expected reaction is observed).

While method 500 described above performs a diagnostic test on the dual parallel IMVs during engine operation (e.g., idle), it is also possible to perform the method 400 of FIG. 4 in a dual, parallel IMV configuration. In such circumstances, which IMV is tested may be alternated, and the other IMV forced closed for the entirety of the test.

Figure 6:
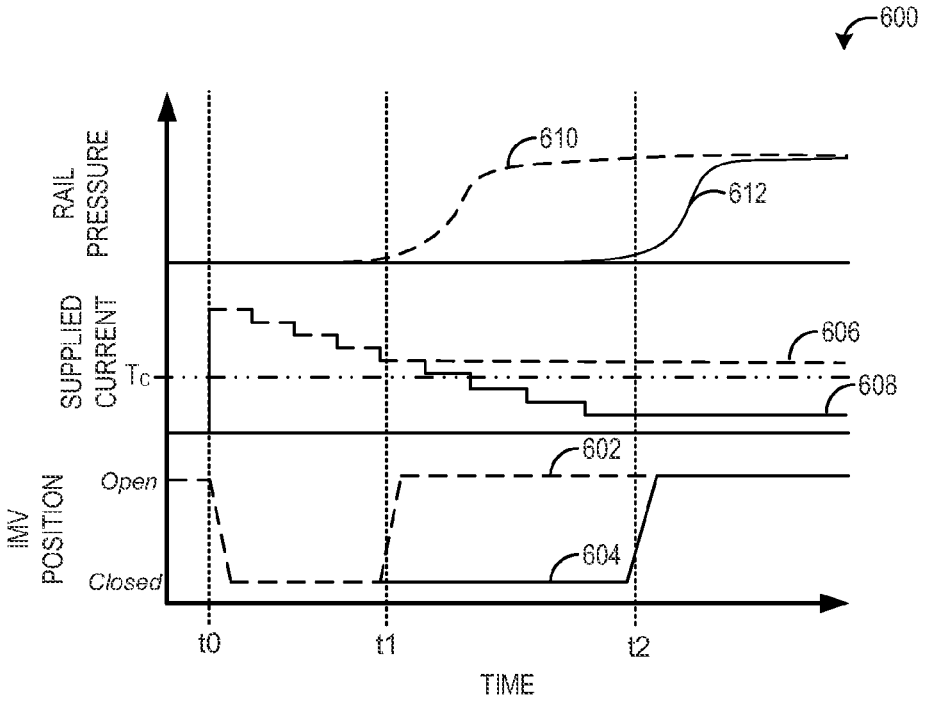
FIGS. 6-7 are diagrams illustrating example operations during the execution of the diagnostic routines of FIGS. 4-5.
Figure 7:
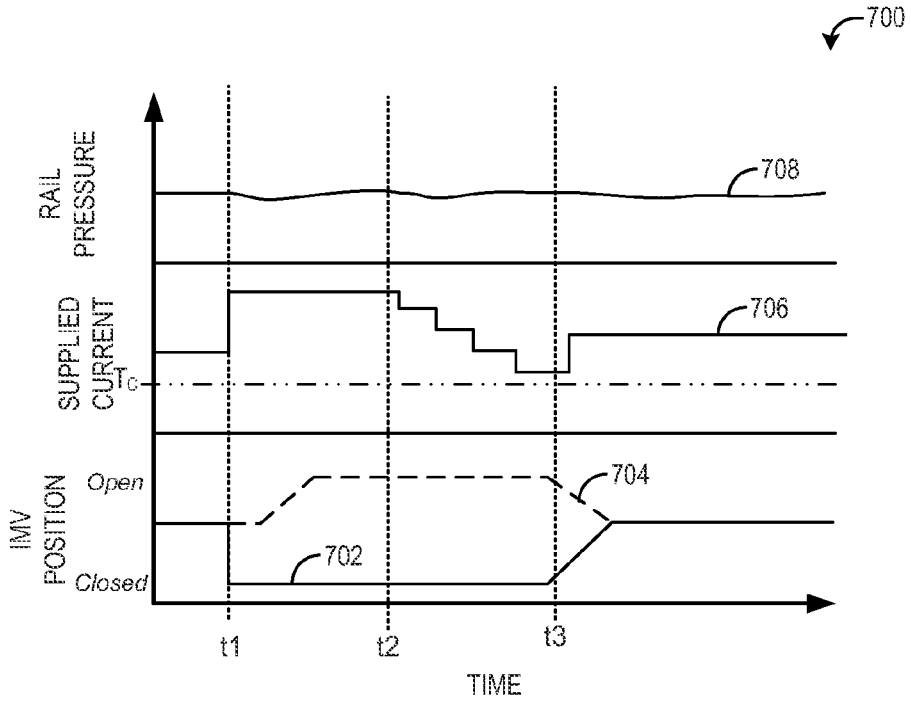

FIGS. 6-7 illustrate example operations during the execution of methods 400 and 500, respectively. For each of FIGS. 6 and 7, IMV position, supplied current, and fuel rail pressure are illustrated over time, with time depicted along the horizontal axis and each respective operating parameter depicted along the vertical axis.

Referring first to FIG. 6, a diagram 600 illustrates example operations during an IMV diagnostic routine carried out in a system with a single IMV. Diagram 600 illustrates operations during a diagnostic routine performed on a non-degraded valve (illustrated by curve 602 and corresponding current supply curve 606 and fuel rail pressure curve 610) and a degraded valve (illustrated by curve 604 and corresponding currently supply curve 608 and fuel rail pressure curve 612). As explained above with respect to FIG. 4, during the diagnostic routine for a single IMV, the engine is in a start/priming sequence and no fuel is yet supplied to the fuel rail. Prior to time t0, the IMV is open (as illustrated by curves 602 and 604) and fuel rail pressure is not pressurized, e.g., is equal to barometric pressure (as illustrated by curves 610 and 612). When the diagnostic routine begins, at time t0, the current supplied to the IMV, illustrated by curves 606 and 608, is increased in order to fully close the IMV. After time t0, the current is then ramped down, e.g., is slowly decreased. While the current is illustrated as being decreased in a step-wise fashion, it is to be understood that the current may be decreased in another suitable manner, such as decreased continuously in a linear manner. Just prior to time t1, the IMV illustrated by curve 602 starts to open, causing an increase in fuel rail pressure, shown by curve 610. At time t1, the increase in fuel rail pressure is detected, and the current level at time t1 for curve 606 is identified as the initial opening characteristic, or opening point, of the IMV. As this current level is greater than a threshold current ($T_C$), it is indicated that the IMV is not degraded.

In another example illustrated in FIG. 6, the IMV valve may not open until time t2, as illustrated by curve 604. During the time between time t1 and t2 the current supplied to the IMV continues to decrease until time t2, as shown by curve 608, when the increase in fuel rail pressure (curve 612) is detected. At time t2, the current level is identified as the initial opening characteristic of the IMV. As this level of current is less than the threshold, the IMV is indicated as degraded.

Rather than simply monitoring for a single current value when the IMV opens, the rate of change of the fuel pressure may be monitored during the duration of the test. For example, rate of change of the fuel pressure in the rail may be monitored from time t0 to time t2 and compared to a threshold rate of change. The rate of change of the non-degraded valve may be different than the rate of the change of the degraded valve (due to the delayed opening of the degraded valve, for example).

FIG. 7 is a diagram 700 illustrating example operations during an IMV diagnostic routine carried out in a system with a dual, parallel IMVs. Diagram 700 illustrates operations during a diagnostic routine performed on a first IMV (curve 702) responsive to adjustment of the position of a second IMV (curve 704). As explained above with respect to FIG. 4, during the diagnostic routine for an IMV in a dual IMV system, the engine is in idle where both IMVs are controlled to the same position to maintain a target fuel rail pressure and/or target fuel flow rate. Thus, prior to time t1, the first IMV and second IMV are both partially open (as illustrated by curves 602 and 604) and fuel rail pressure is maintained at a target pressure that is greater than barometric pressure (as illustrated by curve 708). To keep the IMVs at the designated positions, the current supplied to the IMVs (curve 706) is at a level commanded by the controller. When the diagnostic routine is initiated at time t1, the first IMV is commanded to the fully closed position, as shown by curve 702. To compensate for the closed first IMV, the second IMV opens to a greater extent to maintain the target rail pressure. At time t2, the current supplied to the first IMV is ramped down (e.g., slowly decreased in a stepwise or continuous manner).

Just prior to time t3, the first IMV opens, and thus the second IMV begins to move back to its original, partially open position. The response of the second IMV may be detected, based on output from the feedback controller regulating the position of the IMVs, or other suitable mechanism. At time t3, the current level at the time the second IMV responds is identified as the initial opening characteristic (or opening point) of the first IMV. Once the first IMV reopens, the first and second IMVs may resume their original position. Further, the fuel rail pressure may remain relatively constant throughout the entirety of the diagnostic routine, as depicted by curve 702, although in some examples the fuel rail pressure may fluctuate when the first IMV opens and/or when the second IMV responds. As illustrated in FIG. 7, the current level when the first IMV reopens is greater than the current threshold ($T_C$), and thus it is determined that the first IMV is not degraded, as the first IMV showed the expected response (e.g., opening) during the expected time frame.

While FIG. 7 depicts a single current threshold, it is to be understood that in some embodiments, two current thresholds may be used—a first, higher threshold and a second, lower threshold, where if the initial opening characteristic of the first IMV corresponds to a current level higher than the first threshold or lower than the second threshold, degradation of the first IMV is indicated. Further, the threshold current for the single IMV diagnostic routine may be the same as the threshold current for the dual IMV diagnostic routine, or it may be different.

The diagnostic routines described above for the single IMV system and dual IMV system include comparing a supplied amount of current when an IMV opens to an expected current. However, other IMV parameters may be monitored to determine if the opening characteristic of the IMV indicates degradation. The other parameters may include a change in current over time, a change in electrical resistance, an amount of time it takes from when the current is ramped up or down to when the IMV opens, or other parameters.

In an embodiment, a system comprises a valve configured to regulate a fuel flow, and a controller configured to determine degradation of the valve based on an initial opening characteristic of the valve.

An embodiment for a system comprises an inlet metering valve positioned in a fuel supply line upstream of a fuel rail, the fuel rail configured to supply fuel to an engine via one or more fuel injectors; and a controller configured to determine degradation of the inlet metering valve based on an initial opening characteristic of the inlet metering valve.

The initial opening characteristic of the inlet metering valve is determined by a sensed initial opening characteristic from a fully closed position as current being supplied to the inlet metering valve is ramping down. The initial opening characteristic of the inlet metering valve is based at least in part on an amount of current supplied to the inlet metering valve at which fuel pressure in the fuel rail exceeds a threshold pressure due to the inlet metering valve no longer being fully closed.

The controller is configured to sense the initial opening characteristic by ramping down the amount of current supplied to inlet metering valve and monitoring change in fuel pressure in the fuel rail, during engine operating conditions where no fuel is injected out of the fuel rail and one or more fuel pumps configured to supply fuel to the inlet metering valve and/or fuel rail are activated. In one example, the engine operating conditions comprise engine start-up. The controller is configured to determine degradation of the inlet metering valve if the amount of current exceeds a threshold range of current.

The controller is configured to adjust one or more engine operating parameters in response to a determination that the inlet metering valve is degraded. The one or more engine operating parameters may comprise a slew rate of the inlet metering valve and/or gains of a feedback controller used to control a position of the inlet metering valve. The controller is configured to output a notification indicating to an operator to replace the inlet metering valve if the controller determines the inlet metering valve is degraded.

The inlet metering valve is a first inlet metering valve, and the system further comprises a second inlet metering valve positioned in parallel with the first inlet metering valve. The controller is configured to determine degradation of the first inlet metering valve based on the initial opening characteristic of the first inlet metering valve by commanding the first inlet metering valve closed; reducing an amount of current supplied to the first inlet metering valve; determining an amount of current at which the second inlet metering valve responds; and if the amount of current differs from an expected current by more than a threshold amount, indicating degradation of the first inlet metering valve.

The controller is configured to determine that the second inlet metering valve has responded based on a pressure of the fuel rail. The controller is configured to determine degradation of the first inlet metering valve based on the initial opening characteristic of the first inlet metering valve during idle operating conditions.

In an embodiment, a method comprises, during a first condition, maintaining a target fuel flow rate into a fuel rail by adjusting at least one inlet metering valve positioned upstream of the fuel rail; and during a second condition, indicating degradation of the at least one inlet metering valve if an amount of current supplied to the at least one inlet metering valve to reach a designated fuel rail pressure rate of change differs from an expected current by more than a threshold amount of current.

The first condition comprises engine operation with fuel injection, the second condition comprises an engine start prior to commencement of fuel injection, and during both the first and second condition, one or more fuel pumps are activated.

In an embodiment, a system comprises a pressurized fuel rail to supply fuel to an engine via one or more fuel injectors; a first inlet metering valve positioned in a first fuel supply line upstream of the pressurized fuel rail; a second inlet metering valve positioned in a second fuel supply line upstream of the pressurized fuel rail; and a controller configured to determine degradation of the first inlet metering valve based on a current level supplied to the first inlet metering valve when the second inlet metering valve responds.

The current level is a current level when the first inlet metering valve opens from a fully closed position, and the first and second inlet metering valves are each configured to regulate a flow of fuel from a common low pressure fuel pump to a common high pressure fuel pump, the first and second inlet metering valves arranged in parallel.

The controller is configured to determine degradation of the first inlet metering valve based on the current level when the first inlet metering valve opens by, during idle engine operation, commanding the first inlet metering valve closed and identifying the current level supplied to the first inlet metering valve when the second inlet metering valve responds. The second inlet metering valve responds to an amount of current supplied to the first inlet metering valve being reduced. Each of the first and second inlet metering valves are adjustable to a plurality of restrictions, and if the first inlet metering valve is degraded, the controller is configured to adjust the first inlet metering valve to only a subset of the plurality of restrictions.

In another embodiment, a method comprises determining, with a controller, an initial opening characteristic of a valve configured to regulate a fuel flow. The method further comprises determining degradation of the valve based on the initial opening characteristic of the valve that is determined.

In another embodiment, a method comprises determining, with a controller, an initial opening characteristic of a valve configured to regulate a fuel flow. The method further comprises determining degradation of the valve based on the initial opening characteristic of the valve that is determined. The initial opening characteristic of the valve is determined by a sensed initial opening characteristic of the valve from a fully closed position as current being supplied to the valve is ramping down.

In another embodiment, a method comprises determining, with a controller, an initial opening characteristic of an inlet metering valve positioned in a fuel supply line upstream of a fuel rail, the fuel rail configured to supply fuel to an engine via one or more fuel injectors. The method further comprises determining degradation of the valve, with the controller, based on the initial opening characteristic of the valve. The initial opening characteristic of the inlet metering valve is determined by the controller based at least in part on an amount of current supplied to the inlet metering valve at which fuel pressure in the fuel rail exceeds a threshold pressure due to the inlet metering valve no longer being fully closed.

In another embodiment, a method comprises determining, with a controller, an initial opening characteristic of an inlet metering valve positioned in a fuel supply line upstream of a fuel rail, the fuel rail configured to supply fuel to an engine via one or more fuel injectors. The method further comprises determining, with the controller, degradation of the valve based on the initial opening characteristic of the valve. The initial opening characteristic of the inlet metering valve is determined (by the controller) based at least in part on an amount of current supplied to the inlet metering valve at which fuel pressure in the fuel rail exceeds a threshold pressure due to the inlet metering valve no longer being fully closed. The method further comprises, with the controller, sensing the initial opening characteristic by ramping down the amount of current supplied to the inlet metering valve and monitoring change in fuel pressure in the fuel rail, during engine operating conditions (e.g., engine start-up) where no fuel is injected out of the fuel rail and one or more fuel pumps configured to supply fuel to the inlet metering valve and/or fuel rail are activated. The method may further comprise determining degradation of the inlet metering valve if the amount of current exceeds a threshold range of current.

In any of the embodiments herein, a controller may be configured for (or a related method may include) automatic control an engine, vehicle, or other mechanical/electro-mechanical system (e.g., in which the engine is installed) based at least in part and/or responsive to a determination that an inlet metering valve or other valve is degraded. Control may include causing the engine, vehicle, or other mechanical/electro-mechanical system to transition from a first operational state to a different, second operational state, including operational states that involve movement of one or more parts, e.g., a change of movement from one level of non-zero movement to another level of non-zero movement, a change from a level of non-zero movement to a stopped, no-movement condition, a change from a stopped, no-movement condition to a level of non-zero movement, or combinations thereof. (As one example, one or more engine operating parameters may be adjusted in response to a determination that the inlet metering valve is degraded. The one or more engine operating parameters may include a slew rate of the inlet metering valve, and/or a gain used to control a position of the inlet metering valve.) Control may also include outputting signals to control display of information and/or storage of information. For example, the outputted signals may be for controlling a display screen (or other I/O device) to display a notification indicating to an operator to replace the valve.

As used herein, an element or step recited in the singular and proceeded with the word "a" or "an" should be understood as not excluding plural of said elements or steps, unless such exclusion is explicitly stated. Furthermore, references to "one embodiment" of the invention do not exclude the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A system comprising:

a valve configured to regulate a fuel flow; and a controller configured to determine degradation of the valve based on an initial opening characteristic of the valve.

2. The system of claim 1, wherein the initial opening characteristic of the valve is determined by a sensed initial opening characteristic from a fully closed position as current being supplied to the valve is ramping down.

3. The system of claim 1, wherein the valve is an inlet metering valve positioned in a fuel supply line upstream of a fuel rail, the fuel rail configured to supply fuel to an engine via one or more fuel injectors, and wherein the initial opening characteristic of the inlet metering valve is based at least in part on an amount of current supplied to the inlet metering valve at which fuel pressure in the fuel rail exceeds a threshold pressure due to the inlet metering valve no longer being fully closed.

4. The system of claim 3, wherein the controller is configured to sense the initial opening characteristic by ramping down the amount of current supplied to the inlet metering valve and monitoring change in fuel pressure in the fuel rail, during engine operating conditions where no fuel is injected out of the fuel rail and one or more fuel pumps configured to supply fuel to the inlet metering valve and/or fuel rail are activated.

5. The system of claim 4, wherein the engine operating conditions comprise engine start-up.

6. The system of claim 4, wherein the controller is configured to determine degradation of the inlet metering valve if the amount of current exceeds a threshold range of current.

7. The system of claim 3, wherein the controller is configured to adjust one or more engine operating parameters in response to a determination that the inlet metering valve is degraded.

8. The system of claim 7, wherein the one or more engine operating parameters comprise one or more of a slew rate of the inlet metering valve and a gain used to control a position of the inlet metering valve.

9. The system of claim 3, wherein the controller is configured to output a notification indicating to an operator to replace the inlet metering valve if the controller determines the inlet metering valve is degraded.

10. The system of claim 3, wherein the inlet metering valve is a first inlet metering valve, and further comprising a second inlet metering valve positioned in parallel with the first inlet metering valve.

11. The system of claim 10, wherein the controller is configured to determine degradation of the first inlet metering valve based on the initial opening characteristic of the first inlet metering valve by:

commanding the first inlet metering valve closed;

reducing an amount of current supplied to the first inlet metering valve;

determining an amount of current at which the second inlet metering valve responds; and if the amount of current at which the second inlet metering valve responds differs from an expected current by more than a threshold amount, indicating degradation of the first inlet metering valve.

12. The system of claim 11, wherein the controller is configured to determine that the second inlet metering valve has responded based on a pressure of the fuel rail.

13. The system of claim 11, wherein the controller is configured to determine degradation of the first inlet metering valve based on the initial opening characteristic of the first inlet metering valve during idle operating conditions.

14. A method, comprising:

during a first condition, maintaining a target fuel flow rate into a fuel rail by adjusting at least one inlet metering valve positioned upstream of the fuel rail; and during a second condition, indicating degradation of the at least one inlet metering valve if an amount of current supplied to the at least one inlet metering valve to reach a designated fuel rail pressure rate of change differs from an expected current by more than a threshold amount of current.

15. The method of claim 14, wherein the first condition comprises engine operation with fuel injection, wherein the second condition comprises an engine start prior to commencement of fuel injection, and wherein during both the first and second condition, one or more fuel pumps are activated.

16. A system, comprising:

a pressurized fuel rail to supply fuel to an engine via one or more fuel injectors;

a first inlet metering valve positioned in a first fuel supply line upstream of the pressurized fuel rail;

a second inlet metering valve positioned in a second fuel supply line upstream of the pressurized fuel rail; and a controller configured to determine degradation of the first inlet metering valve based on a current level supplied to the first inlet metering valve when the second inlet metering valve responds.

17. The system of claim 16, wherein the current level is a current level when the first inlet metering valve opens from a fully closed position, and wherein the first and second inlet metering valves are each configured to regulate a flow of fuel from a common low pressure fuel pump to a common high pressure fuel pump, the first and second inlet metering valves arranged in parallel.

18. The system of claim 16, wherein the controller is configured to determine degradation of the first inlet metering valve based on the current level when the second inlet metering valve responds by:

during idle engine operation, commanding the first inlet metering valve closed and identifying the current level supplied to the first inlet metering valve when the second inlet metering valve responds.

19. The system of claim 18, wherein the second inlet metering valve responds to an amount of current supplied to the first inlet metering valve being reduced.

20. The system of claim 16, wherein the first and second inlet metering valves are adjustable to a plurality of restrictions, and wherein if the first inlet metering valve is degraded, the controller is configured to adjust the first inlet metering valve to only a subset of the plurality of restrictions.

* * * * *